US007089967B2

(12) United States Patent
Debaes

(10) Patent No.: US 7,089,967 B2
(45) Date of Patent: Aug. 15, 2006

(54) EQUIPMENT OF A WEAVING MACHINE, METHOD FOR THE MODIFICATION OF A WEAVING MACHINE EQUIPMENT, AND WEAVING PROCESS MAKING USE OF A WEAVING MACHINE HAVING SUCH EQUIPMENT

(75) Inventor: Johny Debaes, Moorslede (BE)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 58 days.

(21) Appl. No.: 10/340,840

(22) Filed: Jan. 13, 2003

(65) Prior Publication Data

US 2003/0136458 A1 Jul. 24, 2003

(30) Foreign Application Priority Data

Jan. 11, 2002 (BE) ..... 2002/0019

(51) Int. Cl.
*D03D 39/00* (2006.01)
*D03D 39/16* (2006.01)

(52) U.S. Cl. ..... 139/37; 139/20; 139/21; 139/59; 139/62; 139/102; 139/192

(58) Field of Classification Search ..... 139/20, 139/21, 37, 59, 62, 102, 192, 391, 397, 398
See application file for complete search history.

(56) References Cited

U.S. PATENT DOCUMENTS 2,070,251 A 2/1937 Bird
2,950,741 A * 8/1960 Janney et al. ..... 139/39
3,014,502 A * 12/1961 Valentine ..... 139/21
3,115,436 A * 12/1963 Bloch et al. ..... 428/93
3,204,669 A * 9/1965 Valentine ..... 139/46
4,903,737 A * 2/1990 Bottger et al. ..... 139/190
5,289,852 A * 3/1994 Migliorini et al. ..... 139/192
5,482,091 A * 1/1996 Debaes ..... 139/391
5,544,676 A * 8/1996 Derudder ..... 139/192
5,570,725 A * 11/1996 Musha et al. ..... 139/192
5,598,875 A * 2/1997 Musha et al. ..... 139/192

(Continued)

FOREIGN PATENT DOCUMENTS

EP 1122347 8/2001

(Continued)

*Primary Examiner*—John J. Calvert
*Assistant Examiner*—Robert H Muromoto
(74) *Attorney, Agent, or Firm*—James Creighton Wray

(57) ABSTRACT

An equipment of a weaving machine in which pile warp yarns (7–13), (16–22) extend through the space between the reed dents and are distributed between a number of pile warp yarn systems and provided on the weaving machine to weave a pile fabric. A group of pile warp yarns (7–22) extend through each space between the reed dents and comprise pile warp yarns of at least two pile warp yarn systems (7–13), (16–22). Because of this it is possible to weave pile fabrics having higher pile densities at a certain reed setting. It is an easy and quick method to modify the equipment of a weaving machine, maintaining the reed setting and the pile warp yarns of each space between the reed dents being distributed between at least two pile warp yarn systems. Furthermore, a weaving process is provided in which, per space between the reed dents the pile warp yarns (7–13), (16–22) of at least two pile warp yarn systems are supplied and a pile fabric woven in that manner. The number of complete backing warp yarn systems is smaller than or equal to the number of pile warp yarn systems.

22 Claims, 1 Drawing Sheet

U.S. PATENT DOCUMENTS 5,672,248 A * 9/1997 Wendt et al. ..... 162/109
5,758,697 A * 6/1998 Musha et al. ..... 139/192
5,762,110 A * 6/1998 Enomoto et al. ..... 139/192
6,010,652 A * 1/2000 Yoshida ..... 264/103
6,073,660 A * 6/2000 Anthony et al. ..... 139/192
6,182,708 B1 2/2001 Smissaert
6,213,163 B1 * 4/2001 Wang ..... 139/192
6,336,475 B1 * 1/2002 Dewispelaere et al. ..... 139/391
6,733,211 B1 * 5/2004 Durie ..... 139/383 R

FOREIGN PATENT DOCUMENTS

JP 06257030 9/1994

* cited by examiner

EQUIPMENT OF A WEAVING MACHINE, METHOD FOR THE MODIFICATION OF A WEAVING MACHINE EQUIPMENT, AND WEAVING PROCESS MAKING USE OF A WEAVING MACHINE HAVING SUCH EQUIPMENT

This application claims the benefit of Belgian Application No. 2002/0019 filed Jan. 11, 2002.

BACKGROUND OF THE INVENTION

This invention relates to an equipment of a weaving machine, in which pile warp yarns extend through the space between reed dents and, distributed between a number of pile warp yarn systems, are provided on the weaving machine in order to weave a pile fabric.

This invention relates to both the equipment of a face-to-face weaving machine and to a single fabric weaving machine, such as, for instance, a rod weaving machine or a loop pile weaving machine.

More particularly, this invention relates to the equipment of a face-to-face jacquard weaving machine, and among others also to rod and loop pile weaving machine having a jacquard machine.

This invention likewise relates to a method for the modification of the equipment of a weaving machine on which pile warp yarns extend through the space between reed dents and, divided between a number of pile yarn systems on the weaving machine, are provided for weaving a first pile fabric, so that a modified equipment is obtained for weaving a second pile fabric having a higher pile density than the first pile fabric and having a modified number of pile warp yarns per pile warp yarn system. It is an understood thing that this method may be applied on all types of face-to face and single fabric weaving machines. A pile warp yarn system is a set of pile warp yarns enabling, in every pile point, to select all colors of pile warp yarns that exist in the installation.

In this patent application, the term "equipment" is used in the meaning of all settings and dispositions, such as among others the reed setting (a number of spaces between dents per meter), the number of hooks of the jacquard machine in order to obtain a number of warp yarn systems per meter, the coupling of the lifting elements of the jacquard machine to the lifting elements of the warp yarns, and the number of pile warp yarns per pile warp yarn system, which are necessary to rig up a weaving machine for the production of a pile fabric having well defined characteristics. This equipment, of course, depends on the characteristics of the fabric to be produced.

It is, for instance, common knowledge, that at a well defined reed setting (for instance 280, 300 or 320 spaces between dents per meter) a fabric having a well defined number of pile warp yarn systems per meter (or pile density) is obtained, and that this reed setting should be changed, if a completely different fabric is to be obtained, having another number of pile warp yarn systems per meter (or pile density) and in which a different number of pile warp yarns has to be provided. Moreover, with a jacquard machine a modification of the number of hooks of the jacquard machine, of the coupling of the lifting elements of the jacquard machine to the lifting elements of the warp yarns, and an entirely new heddling of the warp yarns has to be carried out. Such a modification of the equipment of a weaving machine is particularly time-consuming and laborious.

A first objective of this invention is to provide an equipment of the weaving machine, with which, at a well defined reed setting, a greater number of pile warp yarn systems may be realized than the number for which the weaving reed setting has been physically provided. A second objective of this invention is to provide a method for modifying the equipment of a weaving machine, which is far less laborious and time-consuming than the known method described above.

The first objective is obtained in an efficient manner by an equipment having the features mentioned in the first paragraph of this description, in which a group of pile warp yarns extend through each space between reed dents comprising the pile warp yarns of at least two pile warp yarn systems.

By bringing the pile warp yarns of two or more pile warp yarn systems together through a same space between the reed dents, a plurality of the number of pile warp yarn systems is obtained of the number for which the reed setting used has been provided, and thus a greater pile density.

Preferably, this equipment is carried out in such a manner, that also backing warp yarns extend through the said spaces between the reed dents and, distributed between a number of backing warp yarn systems, are provided on the machine in order to form a backing fabric with the weft yarns to be inserted, while, per space between the reed dents the backing warp yarns are provided with a number of backing warp yarn systems, which is smaller than or equal to the number of pile warp yarn systems per space between the reed dents. If a smaller number of backing warp yarn systems is provided, this means economizing on backing warp yarns.

A backing warp yarn system is a set of backing warp yarns enabling the backing weave for the fabric or for each fabric (upper and lower fabric) to be produced according to the backing weave chosen.

Also one or more backing warp yarns may be left out from one backing warp yarn system. This will limit the warp yarn consumption.

Preferably, the equipment according to this invention is carried out on a face-to-face weaving machine destined to work according to a face-to-face weaving method, in which two backing fabrics are woven one above the another, while, per space between the reed dents, the backing warp yarns are provided with a number of backing warp yarn systems having backing warp yarns for both backing fabrics.

Preferably, the backing warp yarn systems having been heddled in such a manner that the backing warp yarn systems are situated between the pile warp yarn systems which are not separated from one another by a reed dent.

A similar equipment is very advantageous, because the pile warp yarn systems not, separated by a reed dent, are yet well separated by the backing warp yarns of the backing warp yarn system situated in-between in this manner.

With another preferred equipment, the number of pile warp yarn systems in each space between the reed dents is equal to number of backing warp yarn systems and per space between the reed dents, each time, at least one backing warp yarn (or a backing warp yarn system) and a pile warp yarn system are provided next to one another.

With this equipment of a weaving machine a fabric is obtained (which according to this invention may be carried out with a high density) in which at least one backing warp yarn and a pile warp yarn system alternately are found, so that the different pile warp yarn systems (each comprising, for instance, a pile forming pile warp yarn and a number of interlaced non pile forming pile warp yarns) in the fabric are separated from one another by at least one backing warp yarn. This is of great importance to reach a good quality of the back of the fabric.

With this equipment, preferably the same sequence of backing warp yarn systems and pile warp yarn systems are respected in each space between the reed dents.

This invention is implemented in such a manner that, for instance, per space between the reed dents, part of the binding warp yarns of the backing warp yarn system(s) present, are close to the same side of the reed dents, while the remaining ones and the tension warp yarns of the backing warp yarn system(s) are situated between the pile warp yarn systems, situated in the same space between the reed dents.

A possible equipment according to the above-mentioned principle provides, for instance, one backing warp yarn system (having two binding warp yarns and 1 tension warp yarn for the upper fabric and two binding warp yarns and 1 tension warp yarn for the lower fabric), and two pile warp yarn systems, in each space between the reed dents from right to left, two pile warp yarn systems, the first pile warp yarn system, the second other binding warp yarns and the tension warp yarns, and the second pile warp yarn system being provided successively.

A fabric, woven on a weaving machine having such an equipment, therefore comprises successive series of yarns, in which, each time, a pile warp yarn system, two binding warp yarns, a pile warp yarn system and two tension warp yarns are provided successively.

It is an understood thing that the backing warp yarns may be divided in other manners and distributed between the pile warp yarn systems and that, per space between the reed dents, also more than two pile warp yarn systems may be provided per space between the reed dents.

On the basis of the same inventive idea, the second objective mentioned above has also been reached, namely by providing a method for a modification of the equipment of a weaving machine presenting the features mentioned in the fourth paragraph of this description, according to the invention the reed setting being maintained, while the pile warp yarns of each space between the reed dents are distributed between at least two pile warp yarn systems.

Because the reed setting can be maintained, the modification of the equipment of a weaving machine according to this method may be realized much quicker and is far easier to be carried out. Moreover, with a jacquard weaving machine, the number of hooks of the jacquard machine and the coupling of the lifting elements of the jacquard machine to the lifting elements of the warp yarns also may remain unchanged.

With a limited rearranging, a weaving machine which has been equipped for a low pile density (a low number of pile warp yarn systems per meter) and a rather high number of pile warp yarns per pile warp yarn system, whilst maintaining the reed setting, may be equipped for a rather high pile density (pile warp yarn systems per meter) and a relatively low number of pile warp yarns per pile warp yarn system. In this manner, it is possible to weave very different pile fabrics with strongly distinguishing settings as to pile warp yarn systems per meter and as to pile warp yarns per warp yarn system.

With this method, for instance, R pile warp yarn systems per meter and K pile warp yarns per pile warp yarn system are provided in the original equipment, while nR pile warp yarn systems per meter and K/n pile warp yarns per pile warp yarn system are provided in the modified equipment. Obviously, n is here a whole number greater than 0.

In a very preferable method, an even number of different colored pile warp yarn per pile warp yarn system has been provided in the original equipment, and half of these original pile warp yarns per pile warp yarn system are maintained in the modified equipment, while the other half of these pile warp yarns are replaced by pile warp yarns, having the same color as the different pile warp yarns of half of those maintained respectively, and while the pile warp yarns of each space between the reed dents are equally distributed between two pile warp yarn systems, the respective pile warp yarn systems having pile warp yarns of the same color.

Replacing half of the number of pile warp yarns per pile warp yarn system requires a rearrangement in the weaving creel. A bobbin of pile warp yarn is replaced by another bobbin and the new pile warp yarn is tied to the original yarn. When supplying further pile warp yarn the new pile warp yarn is automatically taken along to its exact position on the weaving machine.

When the weaving machine in its original equipment, for example, is provided with a number of hooks of the jacquard machine and a coupling of the lifting elements of the jacquard machine to the lifting elements of the warp yarns, this number of hooks of the jacquard machine and this coupling of the lifting elements of the jacquard machine to the lifting elements of the warp yarns may be maintained in the modified equipment.

Preferably, in each space between the reed dents, each backing warp yarn system is provided between two groups of pile warp yarns, each comprising a same number of pile warp yarns. This is advantageous in order to keep the two groups separated from one another, in case they are used in different pile warp yarn systems in order to produce a pile fabric having a high pile density.

Within the scope of this invention further falls a method for weaving a pile fabric, in which the pile warp yarns are supplied via spaces between the reed dents and, distributed between a number of pile warp yarn systems, are provided on a weaving machine, backing warp yarns being provided on the machine and, in successive working cycles of the weaving machine, weft yarns being inserted into a shed formed between the said warp yarns, so that the backing warp yarns and the weft yarns form a backing fabric and so that at least one pile warp yarn per pile warp yarn system is interlaced in this backing fabric in a pile forming manner and in which, again on the basis of the inventive idea indicated before, the pile warp yarns of at least two pile warp yarn systems are supplied per space between the reed dents.

It should be clear that the weaving process according to this invention and as described above may be provided in order to realize all sorts of backing weaves, such as among others 2/2, 2/2 counterphased, 3/1+1/3 or 1/1 and may also to be applied to all types of single fabric and face-to-face weaving machines.

With this weaving method the backing warp yarns are supplied via the said spaces between the reed dents and, distributed between a number of backing warp yarn systems, provided on the machine, while per space between the reed dents the backing warp yarns are supplied of a number of backing warp yarn systems which is smaller than or equal to the number of pile warp yarn systems per space between de reed dents. A smaller number of backing warp yarn systems will economize on the backing warp yarn and facilitates the crossing of the pile warp yarns during weaving. This latter feature gives a better weaving efficiency.

This weaving method may also be carried out with at least one backing warp yarn system, in which (compared to the other backing warp yarn systems) one or more backing warp yarns have been left out.

Preferably the backing warp yarn systems are supplied between pile warp yarn systems which are not separated from one another by a reed dent. Then the backing warp yarn systems keep the pile warp yarns well separated). Three pile warp yarn systems per space between the reed dents, for instance, may be provided, while two backing warp yarn systems have been provided which are situated between the first and the second pile warp yarn system and between the second and the third pile warp yarn system respectively.

According to a very preferred weaving process, the weaving machine is a face-to-face weaving machine, the method applied is a face-to-face weaving method and per space between the reed dents, the backing warp yarns are provided with a number of backing warp yarn systems having backing warp yarns for both fabrics.

Finally, also a pile fabric produced according to a weaving process as mentioned above falls within the scope of his invention. Such a pile fabric comprises a backing fabric formed by weft yarns and backing warp yarns which are distributed between a number of backing warp yarn systems, and pile warp yarns which, distributed between a number of pile warp yarn systems, have been interlaced in this backing fabric, while a number of these pile warp yarns form the pile, the number of complete backing warp yarn systems being smaller than or equal to the number of pile warp yarn systems.

In such a pile fabric, for instance, one backing warp yarn system and at least two pile warp yarn systems situated next to one another alternately are found or at least one backing warp yarn and one pile warp yarn system alternately. In this last case the back of the fabric is of an excellent quality.

In a most preferred embodiment, a similar pile fabric is characterized in that the pile warp yarns of two pile warp yarn systems extend between the backing warp yarns of two successive backing warp yarn systems, and in that per pile warp yarn system a pile row has been formed. The backing fabric may also comprise incomplete backing warp yarn systems, from which one or more backing warp yarns have been left out.

In the following detailed description of an embodiment of a pile fabric according to this invention the said characteristics and advantages of the invention are further explained. It should be clear that the only intention of this description is to clarify the general principles of this invention by means of a concrete example and that nothing in this description therefore may be interpreted as being a restriction of the scope of the patent rights claimed in the claims, neither of the field of application of this invention.

In the following description, reference is made to the attached figures, by means of reference numbers.

DETAILED DESCRIPTION OF THE PREFERRED EMBODIMENTS

Figure 1:
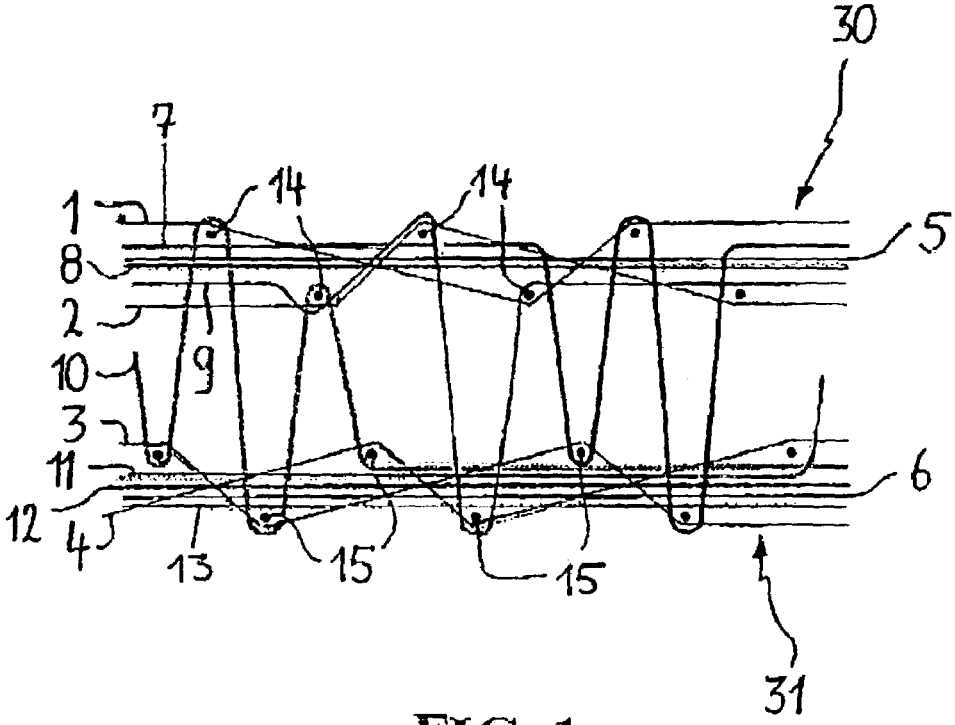
FIGS. 1 and 2 represent two schematic cross sections of a part of a face-to-face pile fabric having a high pile density, the warp yarns shown in the respective figures belong to different warp yarn systems, but which, together, are supplied through a same space between the reed dents.

The face-to-face pile fabric represented in the figures consists of an upper and a lower backing fabric. Both backing fabrics consist of binding warp yarns, tension warp yarns and weft yarns. Pile forming pile warp yarns are interlaced in the upper and lower backing fabric alternately over a weft yarn, while dead pile warp yarns are interlaced in the upper or lower backing fabric.

The face-to-face fabric represented in the figures consists of an upper (30) and a lower backing fabric (31) which are woven according to a well-determined, commonly known backing weave. The upper backing fabric is woven from weft yarns (14), binding warp yarns (1),(2) and tension warp yarns (5). The lower backing fabric (31) is woven from weft yarns (15), binding warp yarns (3),(4) and tension warp yarns (6).

In order to obtain these backing fabrics, the weaving machine is provided with a series of backing warp yarn systems, which comprise the binding warp yarns (1–4) and the tension warp yarns (5,6) for both fabrics represented in FIG. 1. The backing warp yarns of a same backing warp yarn system, extending through the same space between the reed dents.

Figure 2:
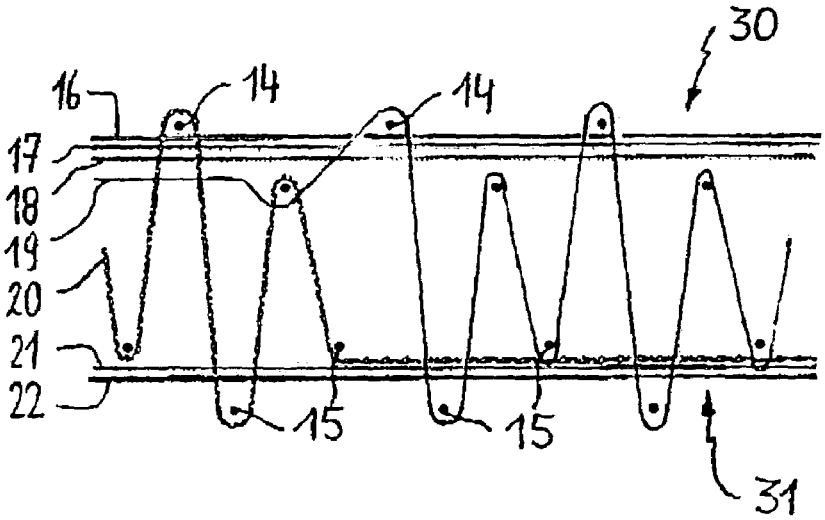

Further, the face-to-face fabric comprises also 14 pile warp yarns (7–13), (16–22) of seven different colors, each time two pile warp yarns having the same color. These pile warp yarns are equally distributed between two different pile warp yarn systems situated next to one another, so that the same colors are found in each pile warp yarn system. The pile warp yarns (7–13) of the one pile warp yarn system are shown in FIG. 1, the pile warp yarns (16–22) of the other pile warp yarn system are represented in FIG. 2. In each pile warp yarn system there are pile warp yarns which are interlaced in the upper (30) and in the lower backing fabric (31) alternately over a weft yarn (14,15) in order to form the pile. Afterwards, these pile warp yarns are cut through between the two backing fabrics, so that each fabric will obtain pile warp ends sticking out from the sides directed towards one another. The pile warp yarns not forming the pile are interlaced in one of the two backing fabrics.

The pile warp yarns (7–13), (16–22) of both pile warp yarn systems are situated in the same space between the reed dents as the backing warp yarns (1–6). These backing warp yarns (1–6) are situated in this space between the reed dents between the pile warp yarns (7–13) of the one pile warp yarn system on the one side, and the pile warp yarns (16–22) of the other pile warp yarn system on the other side and, in this manner, they keep the pile warp yarn systems well separated.

Thus, a pile fabric is obtained having a number of pile warp yarn systems per meter which is double the number for which the reed setting has been provided. In this manner, two pile fabrics are obtained having a high density and 7 different pile warp yarns per pile warp yarn system.

Now, by providing 14 differently colored pile warp yarns and considering them as one single pile warp yarn system, pile fabrics are obtained having a pile density which is only half, but having a number of pile warp yarns per pile warp yarn system, which is twice as much, compared to the fabric represented in the figures.

Rearranging the weaving machine only requires a rearrangement on the weaving creel, where only half of the pile warp yarns have to be replaced in order to obtain 14 different colors per pile warp yarn system, while the number of hooks of the jacquard machine used, the coupling of the lifting elements of the jacquard machine to the lifting elements of the warp yarns and the reed setting may be maintained and there is no need to carry out a new heddling of the pile yarns.

Rearranging an equipment in order to obtain pile fabrics having a great number of pile warp yarns and a low pile density in order to realize an equipment to obtain pile fabrics having a small number of pile warp yarns and a high pile density, and the other way round may be realized particularly quickly and easily with this method.

The invention claimed is:

1. A weaving machine comprising plural pile warp yarn systems, plural reed dents distributed between the plural pile warp yarn systems, plural pile warp yarns distributed in the pile warp yarn systems, wherein the pile warp yarns that extend through each reed dent space include at least two distinct sets of at least two different pile warp yarns, said pile warp yarns being able to be positioned differently during the weaving process.

2. The machine of claim 1, further comprising weft yarns and backing warp yarns distributed between a number of backing warp yarn systems and forming a backing fabric with insertions of the weft yarns, the backing warp yarns extending through the spaces between the reed dents, wherein within per space between the reed dents the backing warp yarns comprise a number of the backing warp yarn systems smaller than or equal to the number of pile warp yarn systems in the space between the reed dents.

3. The machine of claim 2, wherein one or more backing warp yarns are excluded from at least one backing warp yarn system.

4. The machine of claim 2, wherein the weaving machine is a face-to-face weaving machine working in a face-to-face weaving method comprising two backing fabrics woven one above another and wherein per space between the reed dents the backing warp yarns are provided with a number of backing warp yarn systems and wherein the backing warp yarns are for both backing fabrics.

5. The machine of claim 2, wherein the backing warp yarn systems are heddled such that the backing warp yarn systems are situated between pile warp yarn systems not separated by a reed dent.

6. The machine of claim 2, wherein the number of pile warp yarn systems is equal to the number of backing warp yarn systems, and wherein at least one backing warp yarn and a pile warp yarn system are disposed alternately next to one another per space between the reed dents.

7. The machine of claim 6, wherein a same succession of backing warp yarns and pile warp yarn systems are repeated in each space between the reed dents.

8. A method for weaving pile fabrics on a weaving machine comprising providing plural pile warp yarn systems on the machine, providing reed dents with spaces, providing plural pile warp yarns, extending the pile warp yarns through the spaces between the reed dents, distributing the pile warp yarns between a number of the pile warp yarn systems on the weaving machine, weaving a first pile fabric, weaving a second pile fabric having a higher pile density than the first pile fabric and having an additional number of pile warp yarns per pile warp yarn system, maintaining a reed setting, and distributing the pile warp yarns of each space between the reed dents between at least two pile warp yarn systems.

9. The method of claim 8, further comprising:

providing R pile warp yarn systems per meter, providing K pile warp yarns per pile warp yarn system, providing nR pile warp yarn systems per meter, and providing K/n pile warp yarns per pile warp yarn system.

10. The method of claim 9, further comprising providing an even number of differently colored pile warp yarns per pile warp yarn system, maintaining half of the pile warp yarns per pile warp yarn system, replacing another half of the pile warp yarns by pile warp yarns having the same color respectively as the differently colored pile warp yarns of half of the pile warp yarns maintained, distributing equally the pile warp yarns of each space between the reed dents between two pile warp yarn systems, and providing respective pile warp yarn systems having pile warp yarns of the same color.

11. The method of claim 8, further comprising providing the weaving machine with a number of hooks of a jacquard machine including a coupling of lifting elements for the warp yarns, and maintaining the coupling of the lifting elements in the weaving machine.

12. The method of claim 9, further comprising providing each backing warp yarn system in each space between the reed dents between two groups of pile warp yarns extending through the space between the reed dents, each group comprising a same number of pile warp yarns.

13. A method for weaving a pile fabric comprising supplying pile warp yarns via spaces between reed dents, distributing the pale warp yarns between a number of pile warp yarn systems provided on a weaving machine, providing backing pile warps on the weaving machine, inserting weft yarns in successive working cycles of the weaving machine into a shed formed between the pile warp yarns, forming a backing fabric with the backing warp yarns and the weft yarns, interlacing at least one pile warp yarn per pile warp yarn system in a pile forming manner in the backing fabric, and supplying per space between the reed dents the pile warp yarns of at least two pile warp yarn said pile warp yarn systems comprising at least two different pile warp yarns systems, said pile warp yarn systems comprising at least two different pile warp yarns.

14. The method of claim 13, further comprising supplying the backing warp yarns via the spaces between the reed dents and distributing between a number of backing warp yarn systems provided on the weaving machine, supplying per space between the reed dents the backing warp yarns of a number of backing warp yarn systems smaller than or equal to the number of pile warp yarn systems per space between the reed dents.

15. The method of claim 14, further comprising leaving out one or more backing warp yarns from at least one backing warp yarn system.

16. The method of claim 13, wherein the supplying comprises supplying backing warp yarn systems between pile warp yarn systems not separated from one another by a reed dent.

17. The method of claim 13, wherein the weaving machine is a face-to-face weaving machine for a face-to-face weaving method, and further comprising providing per space between the reed dents the backing warp yarns with a number of backing warp yarn systems having backing warp yarns for both fabrics.

18. Pile fabric formed with the weaving machine of claim 1, comprising a backing fabric including weft yarns and backing warp yarns distributed between a number of pile warp yarn systems, pile warp yarns distributed between a number of pile warp yarn systems and interlaced in the backing fabric, a number of the pile warp yarns forming piles, and the number of complete backing warp yarn systems being smaller than or equal to the number of pile warp yarn systems.

19. The pile fabric of claim 18, further comprising alternately at least one backing warp yarn and a pile warp yarn system.

20. The pile fabric of claim 18, further comprising one backing warp yarn system and at least two pile warp yarn systems situated next to one another alternately.

21. The pile fabric of claim 18, wherein the pile warp yarns of two pile warp yarn systems extend between the backing warp yarns of two successive backing warp yarn systems, and wherein a pile row is formed per pile warp yarn system.

22. The pile fabric of claim 18, wherein the backing fabric further comprises backing warp yarn systems with one or more backing warp yarns excluded therefrom.

* * * * *